US012667773B2

(12) United States Patent
Bergant et al.

(10) Patent No.: US 12,667,773 B2
(45) Date of Patent: Jun. 30, 2026

(54) MULTI-BALL POCKETS FOR ROULETTE

(71) Applicant: Interblock d.o.o., Menges (SI)

(72) Inventors: Urban Bergant, Kamnik (SI); John Joseph Connelly, Las Vegas, NV (US); Andrej Tomeljak, Preserje pri Radomljah (SI); Ajda Remskar, Trzic (SI); Mirko Klanjscek, Ljubjiana (SI); Benjamin Zavbi, Kamnik (SI); Emil Kek, Kamnik (SI)

(73) Assignee: INTERBLOCK D.O.O., Las Vegas, NV (US)

( * ) Notice: Subject to any disclaimer, the term of this patent is extended or adjusted under 35 U.S.C. 154(b) by 680 days.

(21) Appl. No.: 18/317,331

(22) Filed: May 15, 2023

(65) Prior Publication Data

US 2023/0338824 A1 Oct. 26, 2023

Related U.S. Application Data

(63) Continuation-in-part of application No. 17/728,545, filed on Apr. 25, 2022.

(60) Provisional application No. 63/483,233, filed on Feb. 3, 2023.

(51) Int. Cl.
*A63F 5/00* (2006.01)

(52) U.S. Cl.
CPC ..... *A63F 5/007* (2013.01); *A63F 5/0088* (2013.01)

(58) Field of Classification Search
CPC ..... A63F 5/007; A63F 5/0088
See application file for complete search history.

(56) References Cited

U.S. PATENT DOCUMENTS

| | | | | |
|---|---|---|---|---|
| 6,209,869 | B1 | 4/2001 | Mathews | |
| 6,467,770 | B1 * | 10/2002 | Matosevic | A63F 5/00 273/274 |
| 6,497,409 | B2 | 12/2002 | Mathews | |
| 6,869,259 | B2 | 3/2005 | Lebkuechner | |
| 8,899,586 | B2 | 12/2014 | Shelburn et al. | |
| 2006/0249899 | A1 | 11/2006 | Lease | |
| 2006/0267274 | A1 * | 11/2006 | Cammegh | G07F 17/3213 273/143 R |
| 2008/0076507 | A1 | 3/2008 | Wertheimer | |
| 2012/0175840 | A1 * | 7/2012 | Zerga | A63F 5/00 273/142 E |
| 2014/0015194 | A1 * | 1/2014 | Pececnik | A63F 5/0082 273/142 E |

(Continued)

*Primary Examiner* — Joseph B Baldori
*Assistant Examiner* — Christopher Glenn
(74) *Attorney, Agent, or Firm* — BakerHostetler

(57) ABSTRACT

A roulette mechanism having a base, a stationary rim mounted on the base having a central opening and a curved face around which roulette balls travel, a rotating roulette wheel configured to spin and positioned in the central opening of the and supported by the base. The roulette wheel includes a movable central cone and pockets distributed around the movable central cone, the pockets hold one or more roulette balls that fall from the rim into pockets. Each pocket corresponds to unique identifiers on the roulette wheel. The cone includes an edge, a number of sub-pockets under the edge and a motor. The edge is configured to stop a roulette ball that has entered a pocket. The motor is configured to raise the edge so that the roulette ball moves from the pocket to the sub-pocket and to lower the edge once the roulette ball is in the sub-pocket.

20 Claims, 13 Drawing Sheets

(56) References Cited

U.S. PATENT DOCUMENTS

2021/0362037 A1* 11/2021 Kulhanek ..... A63F 7/2409

* cited by examiner

MULTI-BALL POCKETS FOR ROULETTE

CROSS-REFERENCE TO RELATED APPLICATIONS

The present application is a continuation-in-part of U.S. patent application Ser. No. 17/728,545, filed Apr. 25, 2022, and claims priority to Provisional Application No. 63/483,233, filed Feb. 3, 2023, each of which are incorporated herein by reference.

TECHNICAL FIELD

The present disclosure relates to gaming apparatus and more particularly to roulette gaming apparatus or systems.

BACKGROUND

Roulette is a popular game played in gaming establishments. In mechanical versions of the game (versus video generated), a roulette ball is launched into a stationary rim having a single angled annular track encircling a spinning roulette wheel. The spinning wheel rotates in the opposite direction of the rotating roulette ball. The roulette ball rotates around the annular track until friction between the roulette ball and the annular track and gravity cause the ball to lose momentum. Upon losing sufficient momentum, the roulette ball exits the annular track and falls on to the roulette wheel.

Between the track and the roulette wheel, the roulette ball may engage with one or more ball stops (or canoes) intervening between the annular track and the roulette wheel, causing the ball to jump about. Eventually the roulette ball will come to rest in one of the numerous equally spaced ball slots located along a circumference of the roulette wheel. Each ball slot among the equally spaced ball slots is isolated from adjacent ball slots by separators positioned radially outward and corresponds to a particular number and color. The particular number represents a result for the game cycle that began when the roulette ball was launched.

As the roulette ball comes to rest, a marker (or dolly) may be used to mark a selection area (or layout) of a display or a physical horizontal surface that is separate from the roulette mechanism. The dolly identifies the particular number and color on the layout corresponding to the ball slot in which the roulette ball came to rest. Winning and losing selections for that game cycle that had been electronically or physically placed on the selection area prior to a selection close time of that game cycle are then determined according to the result. Once the losing and winning selections are resolved, a new game cycle starts.

As it can take an extended period of time from the beginning to the end of each game cycle, various attempts have been made to increase the number of balls that might be used during a single game cycle so that more selections can be placed during each game cycle. U.S. Patent Application Publication Number US 2008/0076507 discloses a multiple ball roulette-style that includes two different balls, but the system is virtual and does not disclose a mechanical system that must account for the physics subjected to the balls and the randomness that can occur in a physical system.

U.S. Pat. No. 8,899,586 discloses a roulette system that has a singular annular track within the roulette wheel and a ball launching system that can launch two or more balls consecutively or substantially simultaneously into the singular annular tracks. U.S. Patent Application Publication Number US 2006/0249899 discloses a roulette-like system that involves multiple rubber balls that are dropped onto two roulette-like wheels positioned below a pyramid-shaped section that causes the balls to bounce around before dropping on the wheels.

U.S. Pat. Nos. 6,209,869, 6,497,409 and 6,869,259 disclose roulette systems that have a rotatable disk positioned within a stationary bowl that extends upwardly and outwardly from a position surrounding the disk. The bowl has a steeply sloped interior face with a plurality of vertically spaced concentric annular grooves forming independent tracks. Each track is designed to receive and retain a ball as the ball is propelled in a circular motion around the track but permit each ball to fall downwardly out of the track upon loss of a predetermined amount of momentum. A croupier (or dealer) would manually put each of the balls into motion, one after another, starting from a lower most track to an upper most track in the hopes that each ball in an upper track would not fall out of its track until each of the balls in the lower tracks had done so in an attempt to prevent one ball from interfering with another ball. The slope of the bowl is steep enough that a ball exiting an upper track would not enter any of the lower tracks and instead would drop directly onto the rotatable disk positioned below. If the croupier spun a lower ball faster than an upper ball, then an upper ball might leave its track before the lower ball and interfere with the lower ball.

Pockaj d.o.o. d/b/a Alfastreet Gaming showed a roulette machine at a trade show that had 10 balls (each subsequently launched at an interval of 0.5 s) that travelled on the same track of a stationary rim at the same time and were purposely allowed to collide with each other.

When a roulette system enables multiple balls to be launched around the rim at the same time, there is a risk that a subsequently launched ball will attempt to land in the same pocket that a prior ball had already landed. Were that to happen, the prior ball would interfere with the subsequent ball and prevent it from landing in the pocket it was going to randomly land within. As a result, the outcome of the game for the subsequent ball would have to be invalidated.

SUMMARY

A roulette mechanism having a base, a stationary rim mounted on the base having a central opening and a curved face around which roulette balls travel, a rotating roulette wheel configured to spin and positioned in the central opening of the and supported by the base. The roulette wheel includes a movable central cone and pockets distributed around the movable central cone, the pockets hold one or more roulette balls that fall from the rim into pockets. Each pocket corresponds to unique identifiers on the roulette wheel. The cone includes an edge, a number of sub-pockets under the edge and a motor. The edge is configured to stop a roulette ball that has entered a pocket. The motor is configured to raise the edge so that the roulette ball moves from the pocket to the sub-pocket and to lower the edge once the roulette ball is in the sub-pocket.

DETAILED DESCRIPTION OF ILLUSTRATIVE EMBODIMENTS

Most roulette mechanisms have a stationary rim, base, and cone and a rotating roulette wheel positioned in the middle of the base. The roulette wheel includes a number of pockets configured to hold the roulette ball. A number between 0 and 36 (and also 00 on some roulette wheels) and a color (typically green for 0 and 00 and alternating between red and black for the other numbers) are assigned to each of the pockets. The stationary rim includes a single angled annular track in which a single roulette ball manually spins. At the beginning of a game cycle, typically after further selections are closed, a dealer will either manually spin the roulette ball in the track or the roulette balls will be launched from a launch tube. The roulette ball spins in the opposite direction of the rotating roulette wheel. When the roulette ball eventually exits the track, the ball will ultimately land in one of the pockets indicating the end of that game cycle.

Figure 1A:
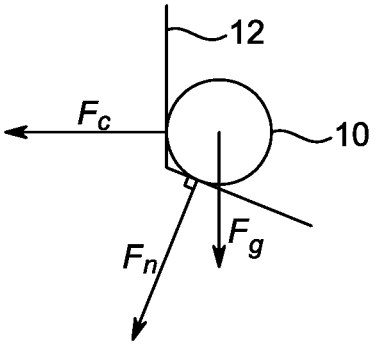
FIG. 1A is an illustration of the key forces acting on a roulette ball within a track.
Figure 1B:
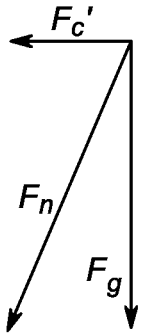
FIG. 1B is an illustration of a deconstruction of the key forces illustrated in FIG. 1A.

FIG. 1A is an illustration of the key forces acting on a roulette ball 10 within a track 12 of a stationary rim (not shown) of a roulette mechanism (not shown). The centrifugal force $F_c$ always points directly outwards from the center of rotation of the roulette ball 10 and decreases in magnitude as the velocity of the ball decreases due to friction along the track 12. The gravity force $F_g$ always points directly downward and is unchanged throughout rotation of the roulette ball 10. The normal force $F_n$ is perpendicular to the surface of the track 12 on which the roulette ball 10 rotates. A deconstruction of the forces, particularly the normal force $F_n$ without the roulette ball 10 and track 12 is shown in FIG. 1B. The roulette ball 10 will circulate along the edge of the stationary rim for as long as the centrifugal force $F_c$ exceeds the magnitude of the horizontal component of the normal force $F_c'$, as shown in FIG. 1B.

In a traditional roulette mechanism, during the rotation phase when the roulette ball is circulating around the track, the following parameters may apply:

Initial rotation time (when the roulette ball leaves the launch tube): $t_0$ (e. g., $t_0$=0.6 s)

Initial rotation velocity:

$$v_0\left(\text{e.g., } v_0 = \frac{1rot}{0.6\,\text{s}} = 1.67\frac{rot}{\text{s}}\right)$$

Critical rotation time (when the roulette ball leaves the rim and begins to circulate slower): $t_c$ (e.g., $t_c$=2.1 s)

Critical rotation velocity:

$$v_0\left(\text{e.g., } v_0 = \frac{1rot}{2.1\,\text{s}} = 0.48\frac{rot}{\text{s}}\right)$$

Ball mass: m (e.g., m=9.0 g)

Ball diameter: d (d=18 mm)

Wheel inclination: φ(e. g., φ=15°)

Wheel diameter: 2R (e. g., 2R=734 mm)

Average number of rotations before stopping: (e. g., 16)

Traditional methods of releasing multiple roulette balls within the same stationary rim have either released the roulette balls into the same track at the same or different times or using completely separate tracks that keep the balls from colliding into one another. The present disclosure is directed to the release of a plurality of roulette balls into the same stationary rim along the same or opposite path with an offset between each release time so that the roulette balls will circulate at different heights and therefore avoid collisions. Sensors in the stationary rim (not shown but positioned around the rim) may measure the initial rotation velocity of each roulette ball at the time of launch. The initial rotation velocity may vary substantially from one launch to the next. Once the initial rotation velocity has been determined the offset before the launch of the next roulette ball may be determined, as further discussed below, in order to insure there will be no collision between the roulette balls.

Figure 2:
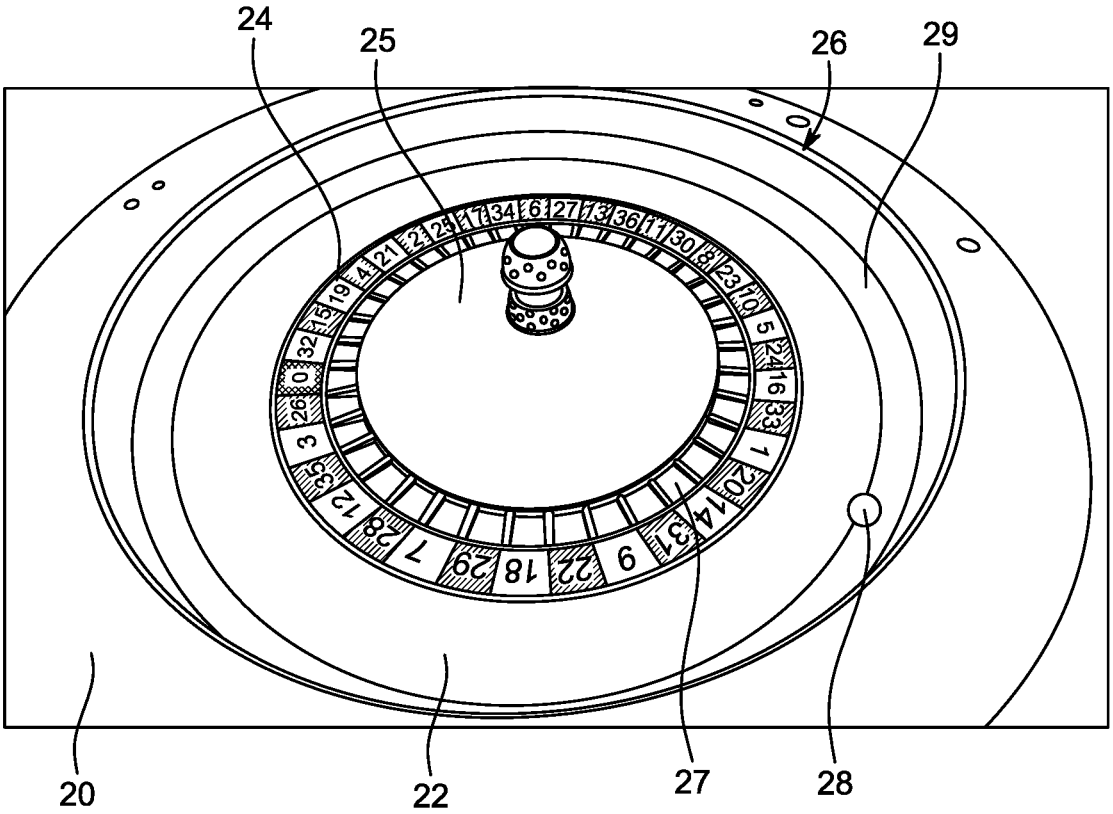
FIG. 2 is a perspective view of a portion of the upper area of a roulette mechanism in accordance with an embodiment.
Figure 3:
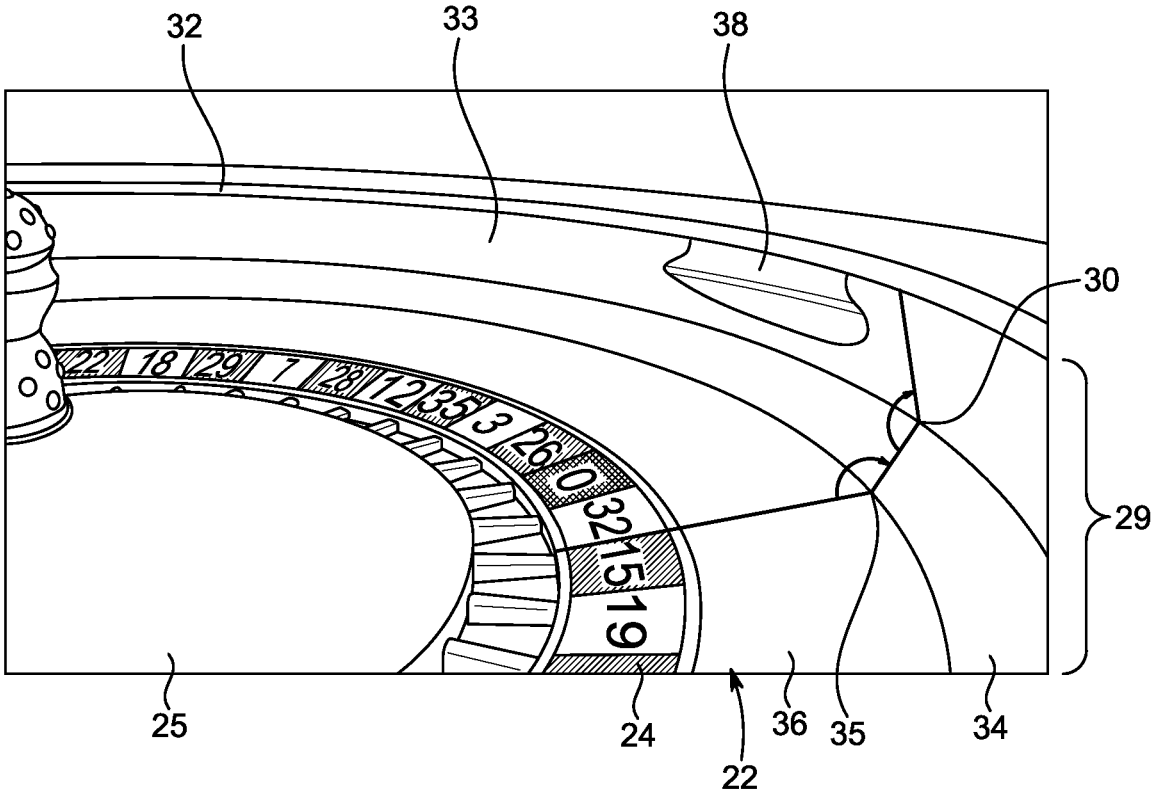
FIG. 3 is a perspective view of a portion of the roulette mechanism of FIG. 2 illustrating more details of the stationary rim and multiple angled annular tracks encircling the spinning roulette wheel.

FIG. 2 illustrates a roulette mechanism 20 with a stationary rim 22 and a standard roulette wheel 24 with a cone 25 and multiple pockets 27, as further discussed herein, that are centrally positioned within the upper area 26 of the roulette mechanism 20. The stationary rim may have two or more substantially flat sections or may be a single smooth surface that gets progressively steeper toward the outer edge 32 as shown in FIG. 3. As shown in FIG. 3, a roulette ball 28 is circulating within one track of two tracks formed by the flat sections 29 of the stationary rim 22. FIG. 3 is a perspective view of a portion of the roulette mechanism of FIG. 2 illustrating more details of the stationary rim and the multiple angled annular tracks encircling the spinning roulette wheel. A more detailed view of the stationary rim 22 and the flat sections 29 is shown in FIG. 3. The flat sections 29 are highlighted with lines indicating the angle of each flat section and designating each resulting track. An upper first annular track 30 or first track 30, closest to the outer edge 32, is defined by the intersection between upper section 33 and middle section 34. A lower second annular track 35 or second track 35 is defined by the intersection between middle section 34 and lower section 36.

The exit or launch point 38 of the ball launch tube is shown in FIG. 3. While only a single launch point is illustrated, there may be two different launch points. In an embodiment, each launch point may launch each of the roulette balls in a direction opposite the direction in which the roulette wheel is spinning. In an embodiment, one launch point may launch a roulette ball in a direction opposite the direction in which the roulette wheel is spinning and another launch point may launch the roulette ball in the same direction the roulette wheel is spinning. The launch points may be located adjacently, at opposite sides of the stationary rim, or elsewhere. Launching multiple different roulette balls in different directions may create a cross spiraling effect (spiraling is further discussed herein) and add interest and enjoyment to the game.

In an embodiment, a first roulette ball may be ejected from the exit 38 of the launch tube so as to land on the first track 30. The steep angle of the slope between the upper section 33 and middle section 34 may ensure that after losing a sufficient amount of speed, the first ball will leave the first track and cross over to the second track 35. A second roulette ball may be ejected from the exit 38 to follow the same trajectory as the first roulette ball, with the second roulette ball only leaving the first track once the first roulette ball has moved to either the lower section 36 or onto the roulette wheel 24. The angles of the intersections between the upper section 33 and middle section 34 and the middle section 34 and the lower section 36 may be calculated so that the two roulette balls never land on the same track at the same time, thereby ensuring a smooth and uninterrupted circulation around the stationary rim 22. The initial rotation time or launch speed of the first roulette ball may be randomly generated as is known in the art in order to insure a fair game. The launch speed of the second roulette ball may be determined based on the measured speed of the first roulette ball.

Figure 4A:
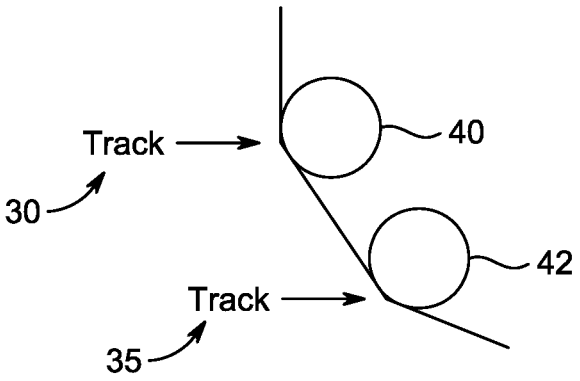
FIG. 4A is an illustration of the position of two roulette balls within different tracks of the stationary rim.
Figure 4B:
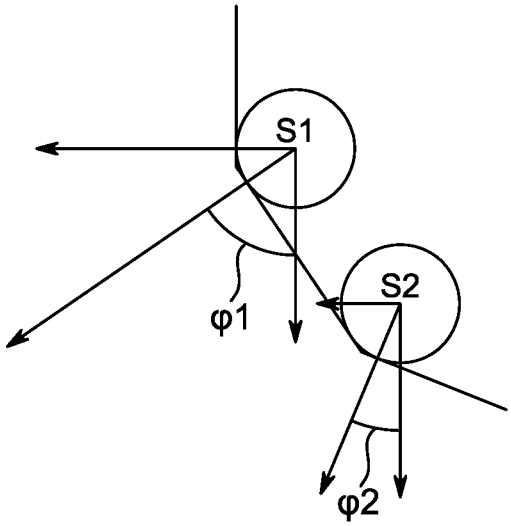
FIG. 4B. is an illustration of the key forces acting on the two roulette balls of FIG. 4A and the wheel inclination corresponding to each ball.

FIG. 4A is an illustration of the position of the first roulette ball 40 in the upper first track 30 and the position of the second roulette ball 42 in the lower second track 35. FIG. 4B. is an illustration of the key forces acting on the first roulette ball 40 and the second roulette ball 42 of FIG. 4A and the wheel inclination φ1 and φ2, respectively. corresponding to each ball. Based on the fixed parameters described above, and assuming the final wheel inclination is equal to the current wheel inclination, the rotation phase may be divided into two rotation stages S1 and S2 as follows:

S1:

Rotation radius: $R_1$ (e. g., $R_1$=367 mm)

Wheel inclination: $\varphi_1$ (e.g., $\varphi_1$=45°)

S2:

Rotation radius: $R_2$ (e. g., $R_2$=349 mm)

Wheel inclination: $\varphi_2$ (e. g., $\varphi_2$=15°)

The centrifugal force $F_c$ may be calculated using the equation:

$$F_c = \frac{mv^2}{r}$$

where m is the mass of the ball, v is the current rotation velocity and r is the rotation radius. The magnitude of the horizontal normal component $$F'_c$$

depends only on the inclination angle of the wheel surface. It can be calculated as follows:

$$F'_c = F_g * \tan\varphi$$

In order to determine the critical point when a roulette ball exits one track to a track below or exits the lowest track and moves towards the roulette wheel, the centrifugal force and the horizontal normal component must be equal, resulting in the following calculation:

$$F_c = F'_c$$

$$\frac{mv^2}{r} = F_g * \tan\varphi$$

$$v^2 = r * g * \tan\varphi$$

$$\text{where } g = 9.81\frac{\text{m}}{\text{s}^2}$$

is the gravitational constant.

Key points in the rotation stage may be as follows:

Roulette ball exits the launch tube (t=0)

$$v = v_0 = 2.5\frac{rot}{\text{s}}$$

Roulette ball leaves S1

$$F_c = F'_c$$

$$v^2 = R_1 * g * \tan\varphi_1$$

Roulette ball leaves S2

$$F_c = F_c'$$

$$v^2 = R_2 * g * \tan\varphi_2$$

In order to guarantee that the roulette balls will not collide, the first roulette ball must be at least a ball-height lower than it was when it exited the launch tube by the time the second roulette ball is released.

Figure 5:
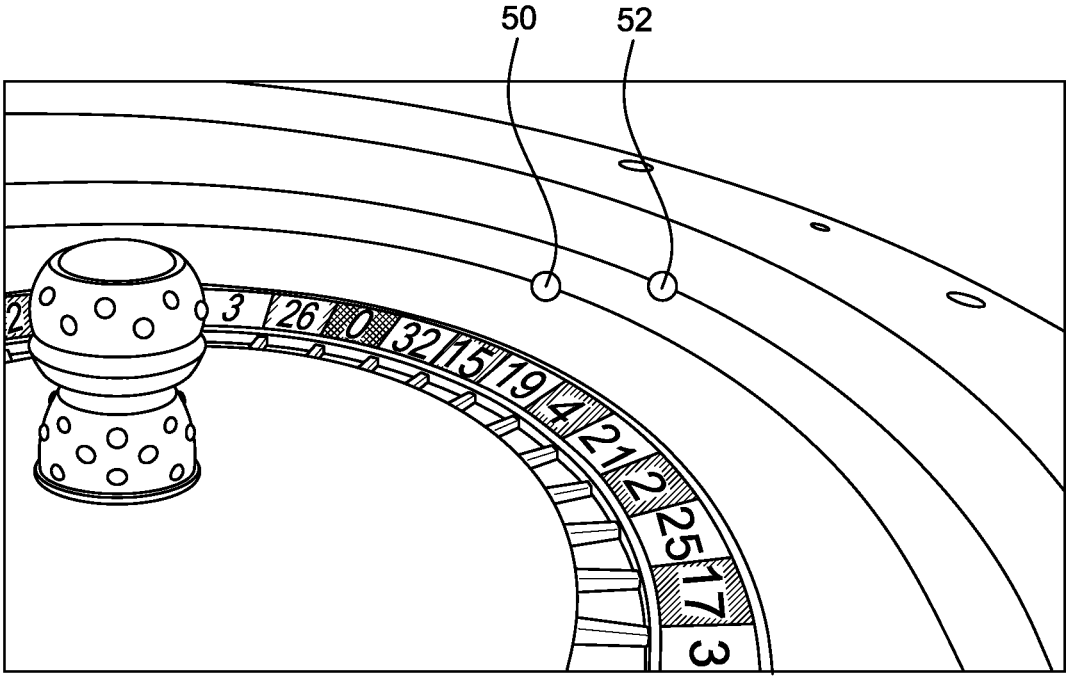
FIG. 5 is a perspective view of a portion of the roulette mechanism of FIG. 2 illustrating two balls in different tracks.
Figure 6:
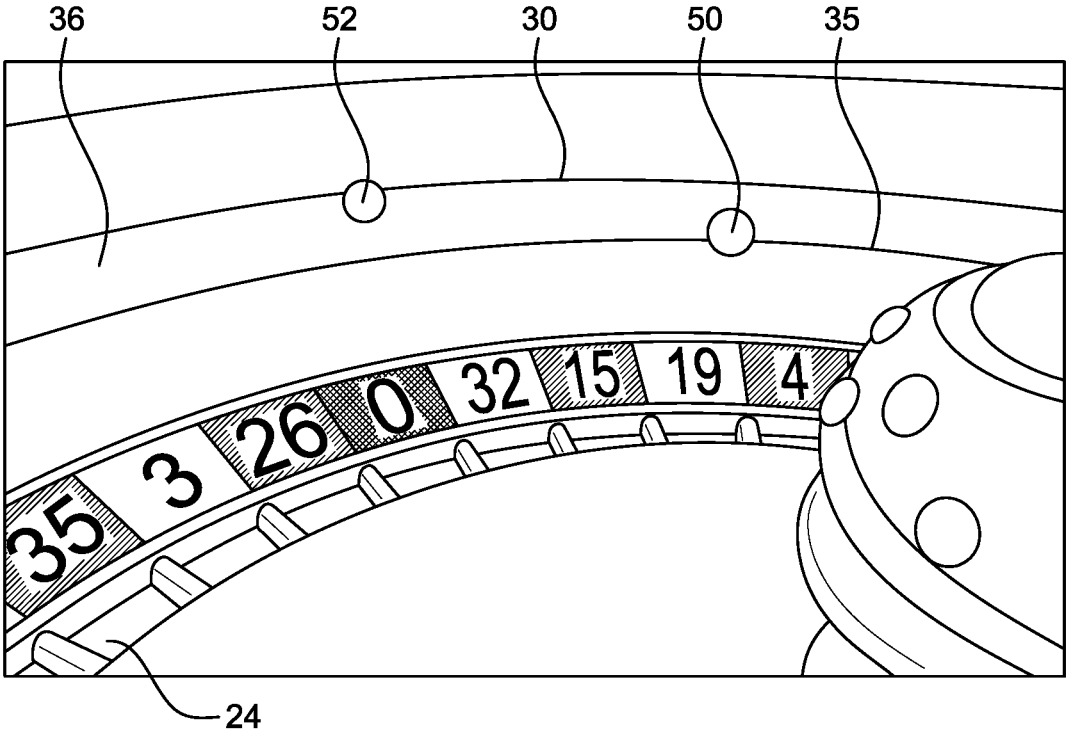
FIG. 6 is a perspective view of a portion of the roulette mechanism of FIG. 2 illustrating two balls in different portions of the tracks as the upper ball leaves its track and moves toward a lower track and the lower ball moves toward the roulette wheel.
Figure 7:
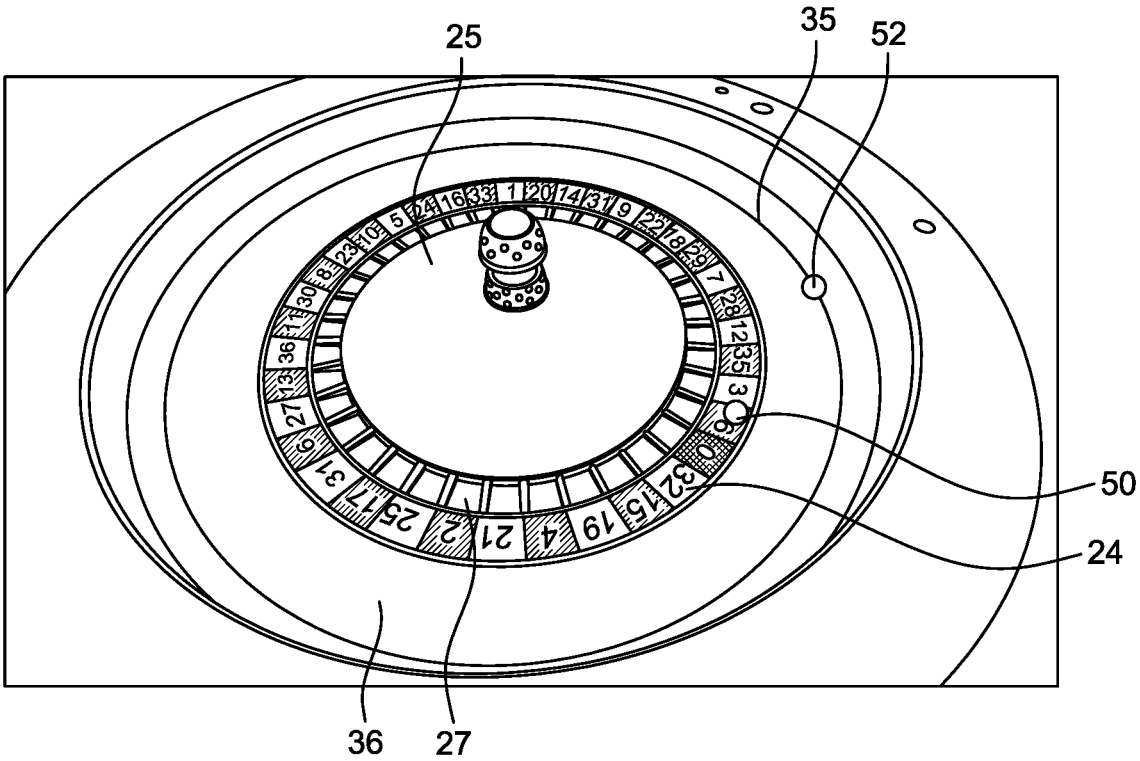
FIG. 7 is a perspective view of a portion of the roulette mechanism of FIG. 2 illustrating a first ball on the spinning roulette wheel and the upper ball now in the lower track.

FIG. 5 is a perspective view of a portion of the roulette mechanism of FIG. 2 illustrating two roulette balls in different tracks, that is a first roulette ball 50 at rotation stage S1 and a second roulette ball 52 at rotation stage S2. FIG. 6 provides a perspective view the same two roulette balls in different portions of the tracks. The first roulette ball 50 is just beginning to move from rotation stage S1 to rotation stage S2, that is it is leaving the upper first track 30 and moving toward the lower second track 35, while the second roulette ball 50 is exiting rotation stage S2 and moving toward the lower section 36 and the roulette wheel 24, as the upper ball leaves its track and moves toward a lower track. FIG. 7 provides a perspective view of the same two roulette balls with the first roulette ball 50 completely off the stationary rim and now on the spinning roulette wheel 24 and headed for landing in a pocket 27. The second roulette ball 52 is in rotation stage S1 of the lower second track 35 and possibly preparing to move to the lower section 36.

Figure 8:
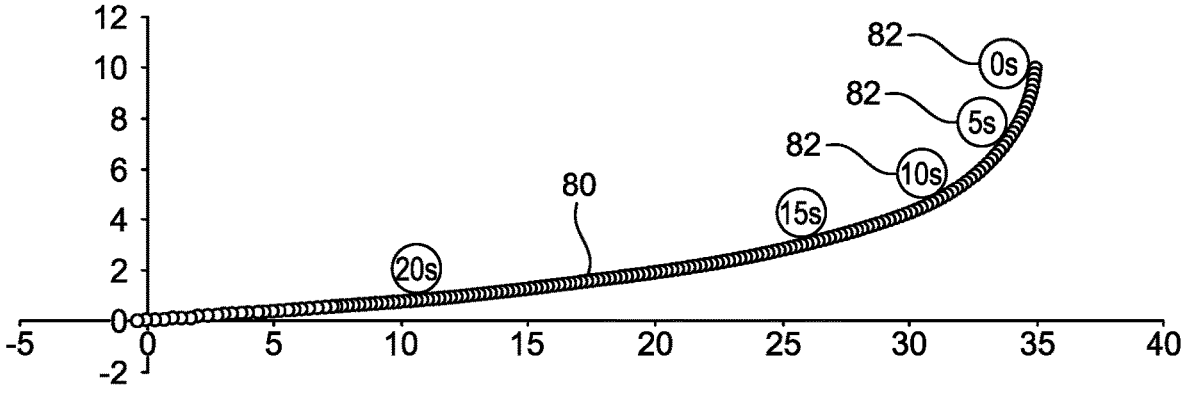
FIG. 8 is an illustration of an embodiment of a stationary rim having a plurality of tracks forming a single path.

While the above embodiments may rely upon inclinations between the flat sections of the stationary rim, the stationary rim does not require intersections between flat sections to define physically distinct tracks that roulette balls may follow during a game cycle. FIG. 8 provides an illustration of an embodiment of a stationary rim 80 having a plurality of tracks, each defined by a rotation stage determined by each roulette ball's angular rotation. Angular rotation of a roulette ball may be defined as follows:

Angular velocity:

$$\omega = \omega_0 * e^{-t/\tau}$$

Path travelled:

$$\Delta\vartheta = \omega * \Delta t$$

$$\vartheta = \int_0^{t_1} \omega dt = \omega_0 \tau \left(1 - e^{-t_1/\tau}\right)$$

In order to guarantee that the roulette balls do not vertically collide it may be necessary to ensure that the height of a first roulette ball on the stationary rim is at least a roulette ball diameter lower than the initial height of a second roulette ball on the stationary rim at the time the second roulette ball is launched. In the case of a flatter stationary rim, the necessary separation may be more horizontal. These conditions may need to hold throughout the game cycle and can be verified based on sensor measurements of the separation and roulette ball velocity throughout the game cycle, with both roulette balls moving toward the roulette wheel at substantially the same rate. This separation assumes that the height of a roulette ball on the stationary rim is directly proportional to the rotation time. That is: $h \propto t$, where h is stationary rim height and t is rotation time.

If the following values are taken as initial conditions for the design of an appropriate working stationary rim of a roulette mechanism:

Initial rotation radius: R (e. g., R=0.35 m)

Initial rotation velocity: $\omega_0$ (e. g., $\omega_0$=12 $s^{-1}$)

Rotational velocity constant: $\tau$ (e. g., $\tau$=10 $s^{-1}$), the shape of the continuously curved stationary rim 80 may appear as shown in FIG. 8. The different numbered roulette balls 82 represent each ball between a launch time of 0 s (seconds), 5 s, 10 s, 15 s, and 20 s. At 0 s the roulette ball makes approximately 2 laps around the stationary rim 80 per second, dropping to approximately 1.2 laps per second at 5 s, approximately 0.8 laps per second at 10 s, and significantly slowing to about 0.3 lap per second by 20 s. However, as can be seen in FIG. 8, as a result of attempting to maintain the height difference between the roulette balls, the curve of the lower portion of the stationary rim 80 levels out significantly, thereby requiring a much larger, by radius, stationary rim than in more traditional roulette mechanisms.

Figure 9:
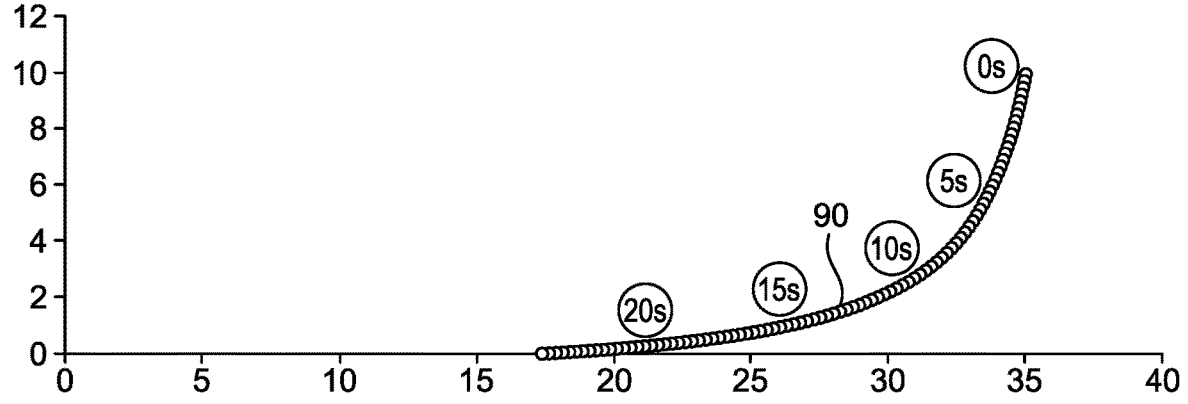
FIG. 9 is an illustration of another embodiment of a stationary rim having a plurality of tracks forming a single path.

FIG. 9 is an illustration of another embodiment of a stationary rim 90 having a plurality of tracks where a constant distance between the centers of rotation of roulette balls following different tracks of a path is maintained. In this case the height of a roulette ball on the stationary rim 90 is directly proportional to the rotation velocity. That is: $h \propto \vartheta$, where h is stationary rim height and $\vartheta$ is rotation velocity. As depicted in FIG. 9, this embodiment enables the stationary rim 90 to have a smally radius yet maintain a sufficient separation between the roulette balls at 0 s, 5 s, 10 s, 15 s, and 20 s.

As shown in FIG. 7, when the first roulette ball 50 falls completely off the stationary rim and onto the spinning roulette wheel 24 it will eventually land in one of the pockets 27. The first roulette ball 50 lands in a pocket 27, it is stopped by the cone 25 and held in place in the pocket by the raised rims of the pocket 27. If the first roulette ball 50 is left in the pocket 27 the second roulette ball 52 will eventually fall off the stationary rim, onto the roulette wheel, and head for its own pocket 27. As previously noted herein, if the second roulette ball 52 attempts to land in the same pocket 27 currently occupied by the first roulette ball, the two roulette balls will interfere with one another and cause one (i.e., determined by the first roulette ball) or both games to be invalidated, so a solution is needed to resolve this problem.

Figure 10A:
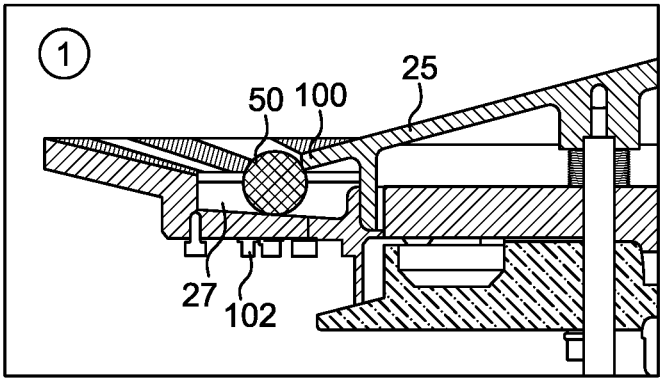
FIG. 10A is a cross-sectional view of a roulette wheel with a movable cone when the cone edge is lowered and a roulette ball is in a pocket in accordance with an embodiment.
Figure 10B:
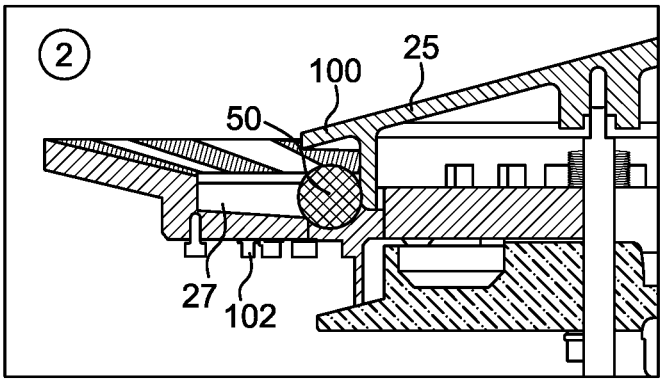
FIG. 10B is a cross-sectional view of a roulette wheel with a movable cone when the cone edge is raised and the roulette ball in the pocket has moved to a storage position in accordance with an embodiment.
Figure 10C:
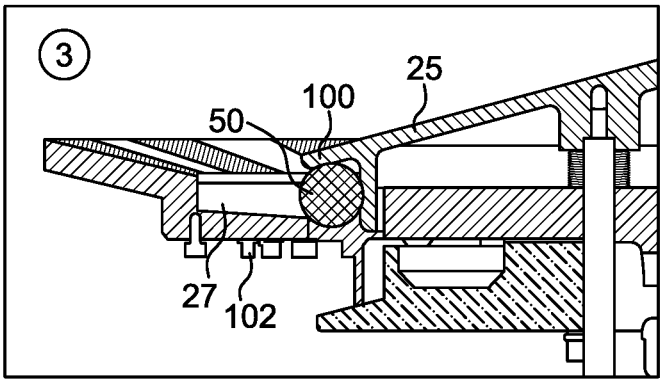
FIG. 10C is a cross-sectional view of a roulette wheel with a movable cone when the cone edge is lowered and the roulette ball in the pocket is in storage in accordance with an embodiment.

FIG. 10A illustrates the first roulette ball 50 in the pocket 27 and resting against an edge 100 of the cone 25 in its normal position during a game. The pocket 27 may be angled downward toward the edge 100 such that the first roulette ball 50 is inclined to rest against the edge 100 even when the roulette wheel is spinning. A sensor 102 either located below the pocket 27, or elsewhere on the roulette mechanism, such as on the rim, may detect the presence of the first roulette ball 50 and trigger reporting or indicating of the outcome of the game, i.e., identifying the color (if applicable) and the number or symbol of the pocket in which the ball resides. As shown in FIG. 10B, the detected presence of the first roulette ball 50 may also result in the edge 100 of the cone 25 being raised by a mechanical device, such as a motor driven belt and pulley, a servo motor or other known device, and result in the first roulette ball 50 rolling under the edge 100 in to a sub-pocket for storage. Once the first roulette ball 50 has been stored, the edge 100 of the cone 25 is lowered back to its normal position, as shown in FIG. 10C. The raising and lowering of the edge 100 of the cone 25 could be performed fast enough to not interfere with second roulette ball's 52 outcome.

Alternatively, a first ball could be launched, with a second ball not launched until the first ball was in a sub-pocket under the edge 100 of the rim. In this manner, the roulette wheel could be stopped once the first ball was in a pocket. The cone could be raised and lowered to get the first ball under the cone, then the wheel could be re-spun and a next ball launched. This could be repeated for multiple balls until a subsequent ball touched a ball in one of the pockets or there was a ball in a pocket and the corresponding sub-pocket.

Figure 11A:
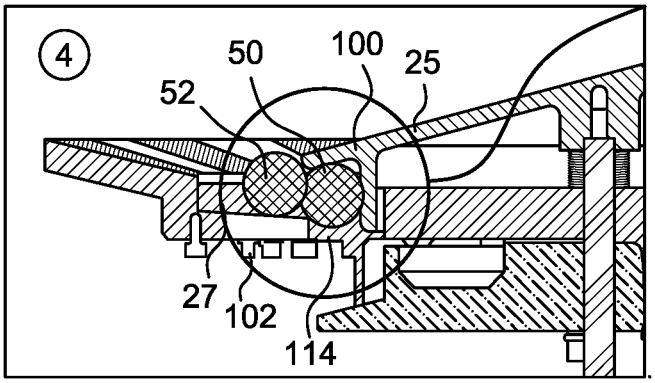
FIG. 11A is a cross-sectional view of a roulette wheel and a movable cone when the cone edge is lowered and the roulette ball in the pocket is in storage and another ball is in an adjacent pocket in accordance with an embodiment.
Figure 11B:
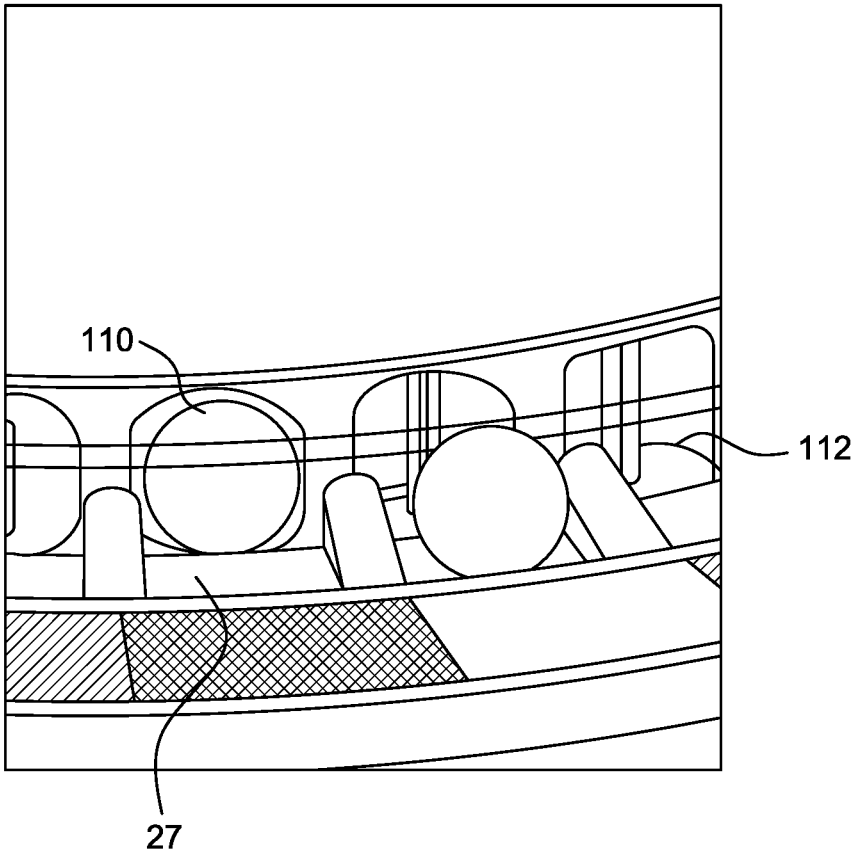
FIG. 11B is a perspective view of two roulette balls in adjacent pockets from FIG. 11A from a different angle.

In its stored position, the first roulette ball 50 may still be visible to players, but it is separated from the second roulette ball 52 by the edge 100 such that the two roulette balls cannot touch one another, as further illustrated in FIG. 11A. As shown in FIG. 11B, when a roulette ball 110 is stored in a sub-pocket under the cone 25, it may be resting in a side pocket 112 of the cone 25 where it may still be seen through the opening of the pocket 27. This makes it possible to continue to show the outcome associated with a first roulette ball while a second roulette ball is still on the rim or landing in a pocket, while maintaining statistically independent outcomes for both roulette balls, even if they land in the same pocket. As shown in FIG. 11A, there may be a trap door 114 at the bottom of each sub-pocket 112 to an opening under each sub-pocket that returns the played roulette balls to the launch magazine under the roulette wheel.

Figure 12:
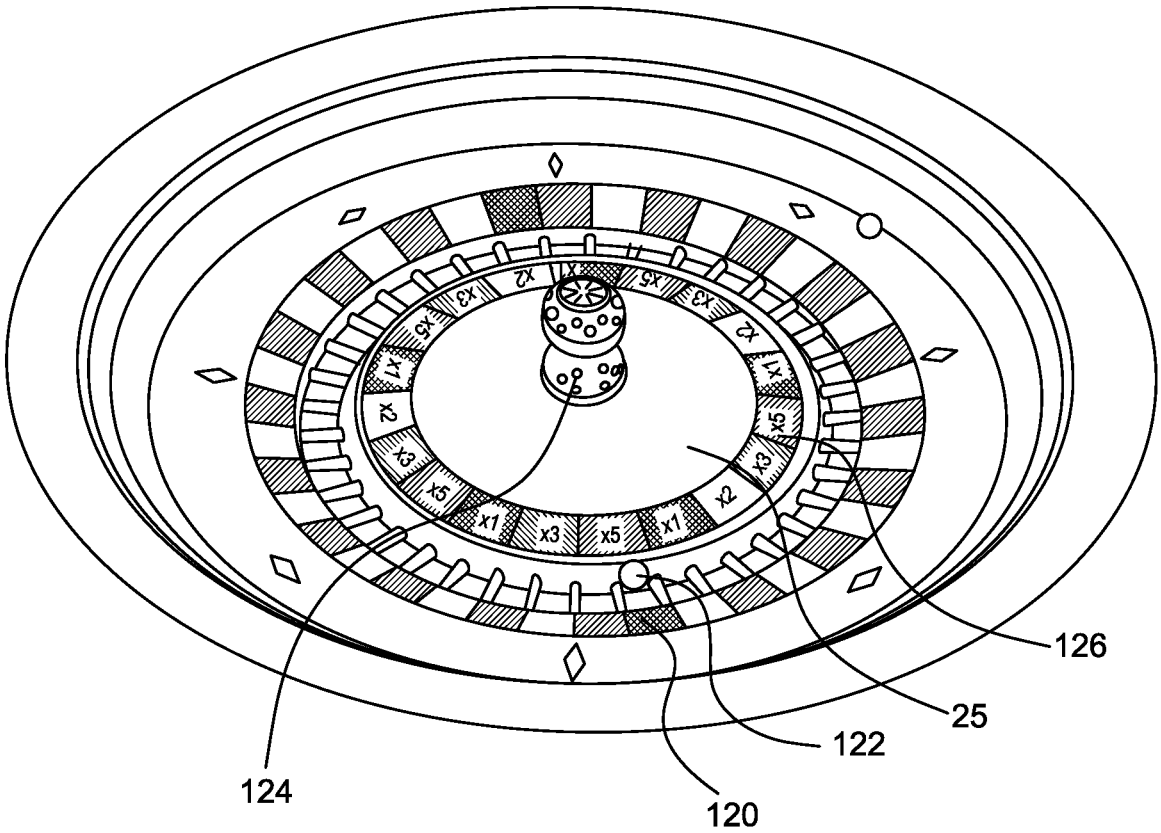
FIG. 12 is a perspective view of a roulette wheel with a movable cone illustrating lighting features and a multiplier wheel on the cone in accordance with an embodiment.

To further enhance the roulette mechanism and make it easier for players to identify the pocket in which a roulette ball has landed lighting could be provided to light up the pocket containing a ball. The lighting could be triggered by the sensor 102 detecting a roulette ball in a pocket. As shown in FIG. 12, the lighting could be located in the cone 25 or the bottom material of the pocket 120 and the associated sub-pocket could be made of translucent material that includes light emitting diodes (LEDs) or liquid crystal displays (LCDs) under the material that can change the color of the number wheel (the number wheel shown in FIG. 12 does not include numbers) corresponding to the pocket, such as from red or black to green, so as to indicate the pocket or sub-pocket holding the roulette ball 122.

Figure 13:
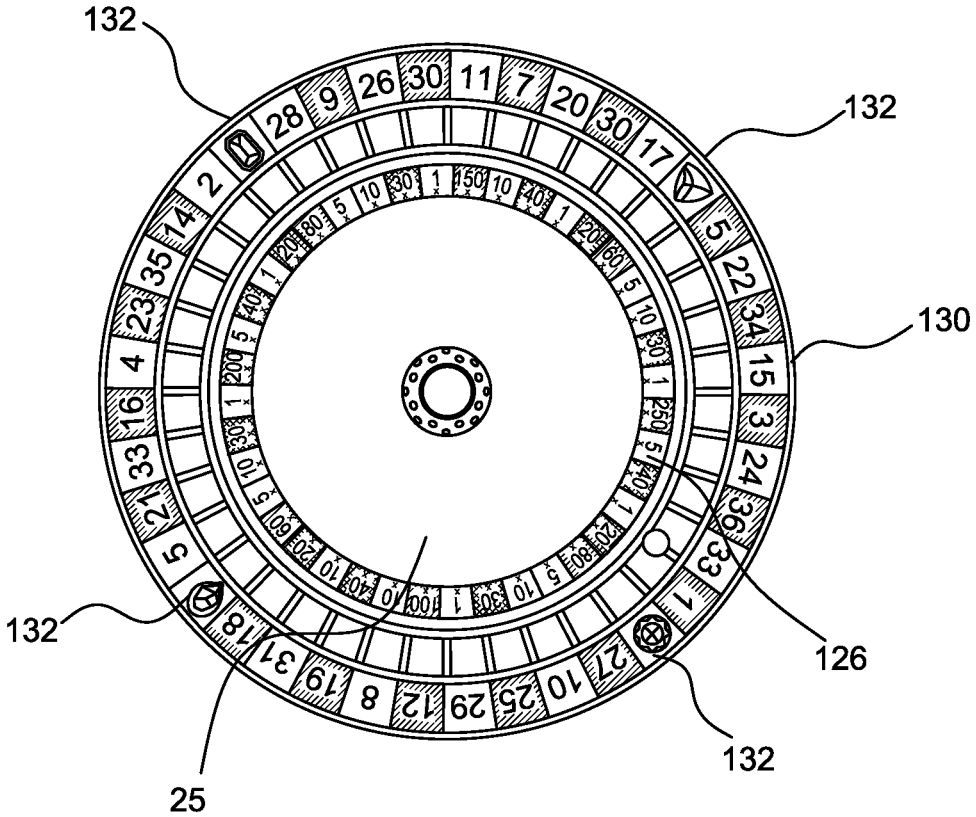
FIG. 13 is a perspective view of a roulette wheel with a movable cone illustrating additional symbols on the roulette wheel and a multiplier wheel on the cone in accordance with an embodiment.

Additional enhancement features include the ability to shine light through crystals imbedded in the turret 124 of the cone 25 during a game or when a roulette ball lands in a pocket to further indicate the outcome of each game or for some other reason. The cone may be lit with lighting as well as can be a multiplier wheel 126 on the cone as shown in FIG. 13 for use in one or more different types of games to be played on the roulette mechanism. The different types of games may utilize the roulette wheel 130, which modifies the standard roulette wheel 24 by adding four additional symbols 132 as shown in FIG. 13 and the multiplier wheel 126.

Figure 14:
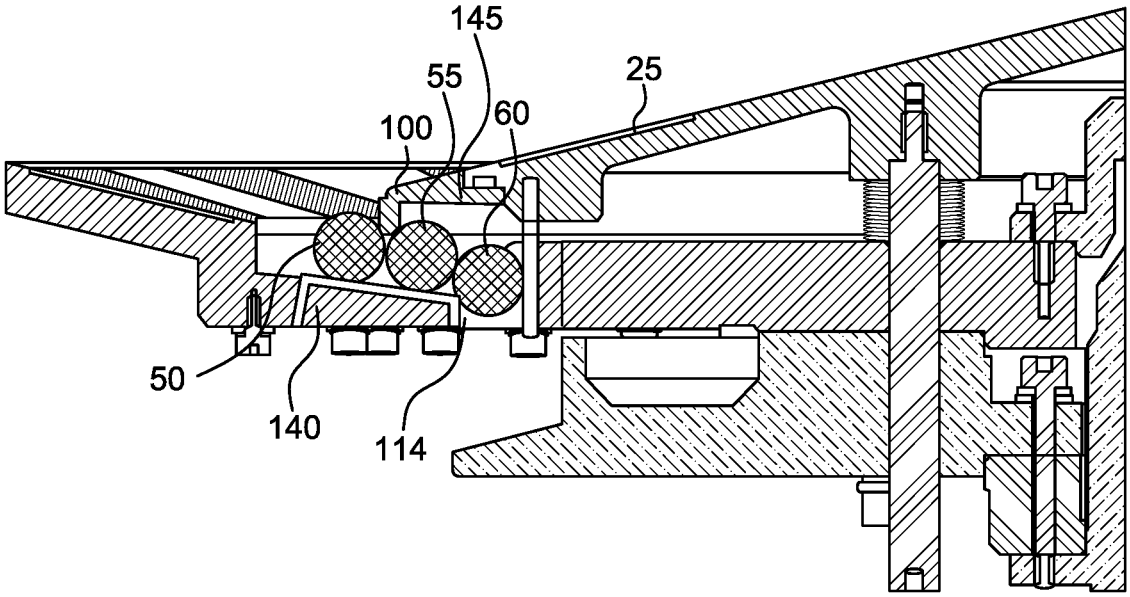
FIG. 14 is a cross-sectional view of a roulette wheel and a movable cone when the cone edge is lowered and multiple roulette balls are stored in a sub-pocket in accordance with an embodiment.

FIG. 14 illustrates an arrangement including an extended sub-pocket configured to store multiple roulette balls. The cone 25 may include an extended portion 145 above a ledge 140 in the rim to create a spacing to store multiple roulette balls within the sub-pocket. FIG. 14 illustrates an example wherein two roulette balls 55, 56 are held within the sub-pocket. The movable cone 25, ledge 140, and extended portion 145 may be configured to hold additional roulette balls, e.g., two, three, four balls, etc., as desired. The sub-pocket may store the multiple roulette balls e.g., roulette balls 55, 60 such that their position does not interfere with the launching of other roulette balls, and the randomness of a launched roulette ball landing within an individual pocket.

Similar to other examples discussed herein, a sensor 102 may be triggered when a roulette ball 50 lands within a pocket and/or touches the edge 100 of the cone. The sensor 102 may indicate a presence of the ball, the outcome of the game, the color of the ball, and the like. Information from sensor 102 may trigger movement of the cone 25 to allow the roulette ball to be received within the sub-pocket. The sensor may be positioned within or on at least one of the edge, the pocket, or the rim.

The sub-pocket may include a trap door 114 on which a roulette ball may be stored. When the trap door 114 opens, the roulette ball drops into a pathway to be returned to the launch magazine under the roulette wheel. The trap door 114 may open to receive a specified number of roulette balls stored within the sub-pocket. For example, the trap door 114 may open to receive only a single ball, e.g., roulette ball 60, at a precise time. In other examples, the trap door 114 may open to receive multiple, or all, roulette balls stored within the sub-pocket.

In some examples, the movement of cone 25 may be coordinated with the movement of the trap door 114. This may ensure that a particular number of balls are kept within the sub-pocket, and/or create space so that the sub-pocket has the capacity to receive an additional roulette ball. The movement of the cone 25 and the trap door 114 may also be independent. For example, the trap door 114 may open when additional roulette balls are needed for the launch magazine, after a period of time, or when a game ends.

Figure 15:
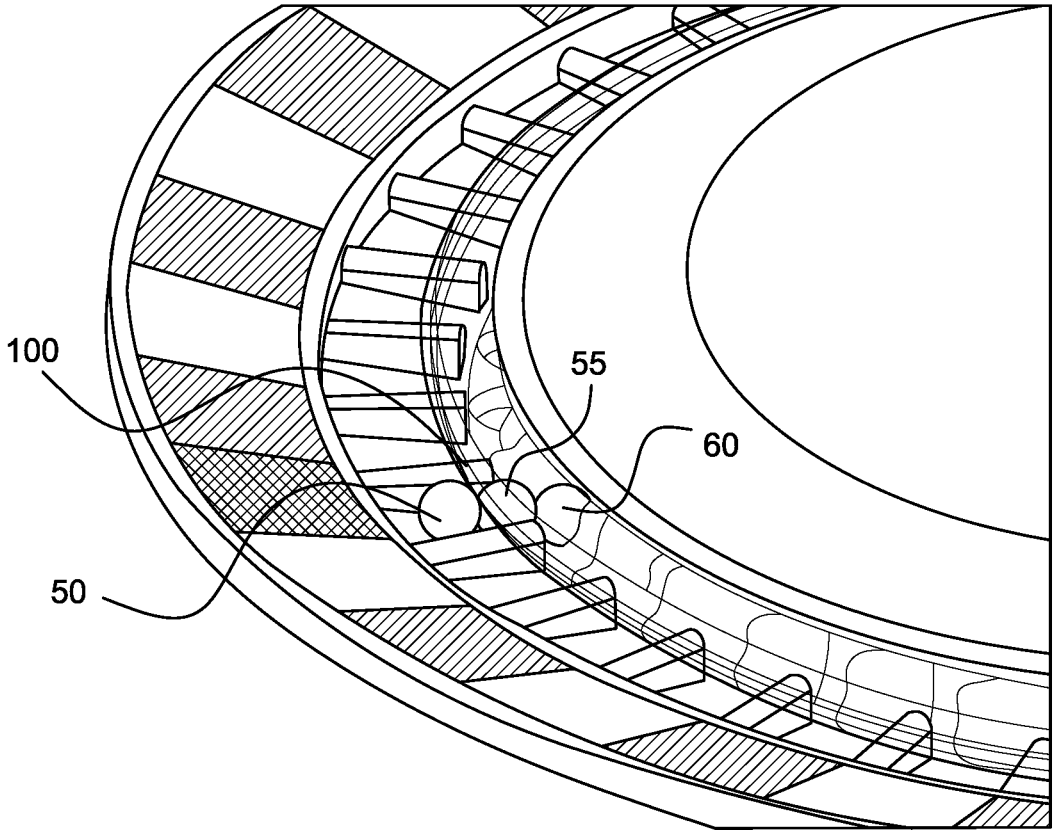
FIG. 15 is a perspective view of multiple roulette balls stored in a sub-pocket in accordance with an embodiment.

FIG. 15 illustrates a perspective view of multiple balls stored within the sub-pocket. In examples, the stored balls, e.g., roulette balls 55, 60, may still be visible to players. Similar to other aspects discussed herein, the first roulette ball 50, may be physically separated from the roulette ball(s) within the sub-pocket by edge 100.

Figure 16:
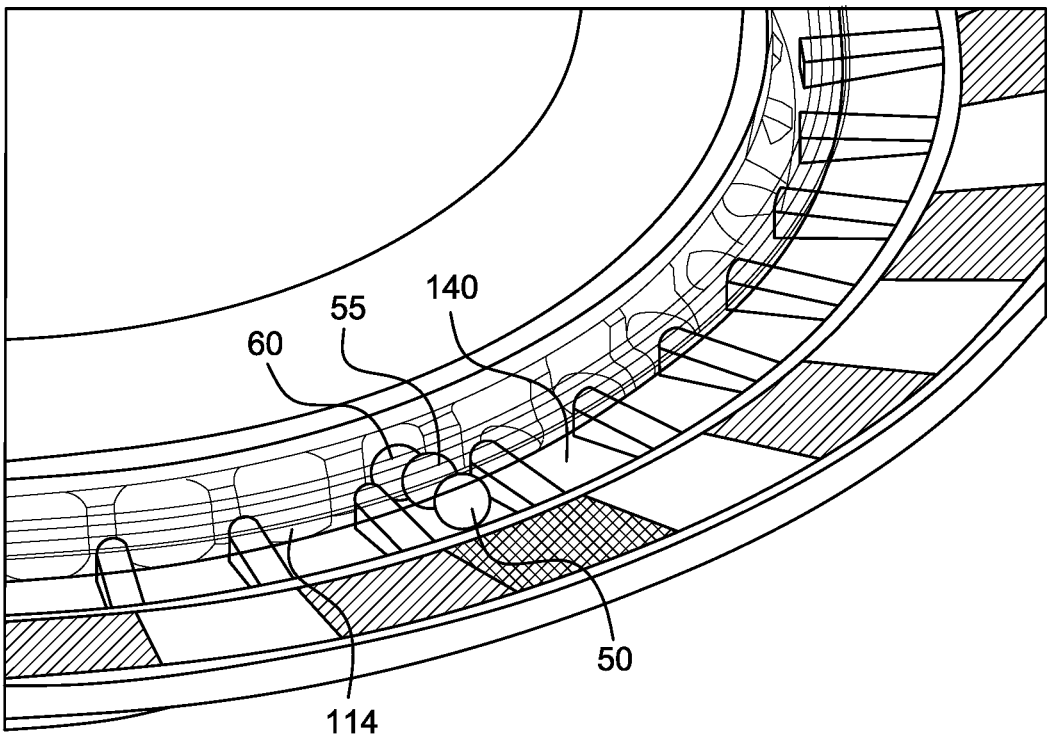
FIG. 16 is a perspective view of multiple roulette balls in a sub-pocket from FIG. 15 from a different angle.

FIG. 16 illustrates an alternate perspective view of multiple balls stored within a sub-pocket. As discussed above, sub-pockets may include a ledge 140 in the rim to hold the multiple roulette balls. In some examples, the ledge 140 is long enough to store at least one roulette ball (e.g., roulette ball 55) within the sub-pocket, and a roulette ball (e.g., roulette ball 50) on the opposite side of the edge 100. The trap door 114 may provide a space for an additional roulette ball (e.g., roulette ball 60) to be stored. The length, sizing, and configuration of these features may be adjusted, as needed, to store more or less roulette balls.

The present disclosure describes particular embodiments and their detailed construction and operation. The embodiments described herein are set forth by way of illustration only and not limitation. Those skilled in the art will recognize, in light of the teachings herein, that there may be a range of equivalents to the exemplary embodiments described herein. Most notably, other embodiments are possible, variations can be made to the embodiments described herein, and there may be equivalents to the components, parts, or steps that make up the described embodiments. For the sake of clarity and conciseness, certain aspects of components or steps of certain embodiments are presented without undue detail where such detail would be apparent to those skilled in the art in light of the teachings herein and/or where such detail would obfuscate an understanding of more pertinent aspects of the embodiments.

Figure 17:
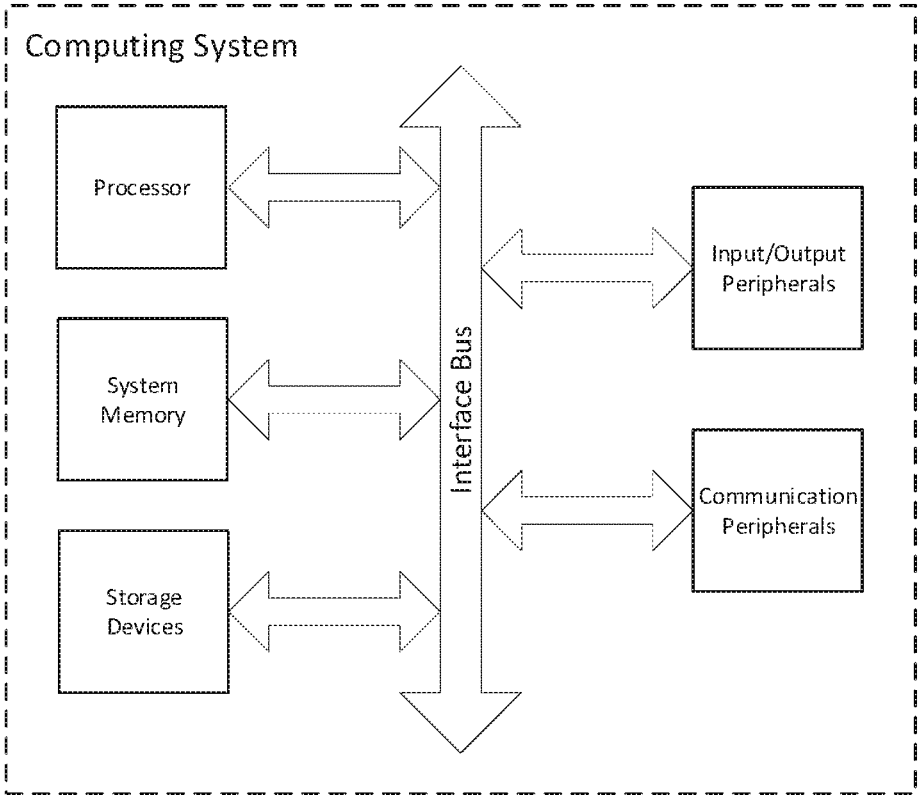
FIG. 17 is a block diagram of an embodiment of a computer system.

Some of the techniques described above can be implemented on a computing device associated with a gaming device (e.g., a roulette mechanism), a plurality of computing devices associated with a plurality of gaming devices, a controller in communication with the gaming device(s) (e.g., a controller configured to synchronize the gaming devices (s)), or a plurality of controllers in communication with the gaming device(s). Additionally, some of the techniques may be distributed between the computing device(s) and the controller(s). FIG. 17 illustrates an exemplary block diagram of a computing system that includes hardware modules, software module, and a combination thereof and that can be implemented as the computing device and/or as the server.

In a basic configuration, the computing system may include at least a processor, a system memory, a storage device, input/output peripherals, communication peripherals, and an interface bus. Instructions stored in the memory may be executed by the processor to perform a variety of methods and operations, including the shooter selection and console mirroring, as described above. The computing system components may be present in the gaming device, in a server or other component of a network, or distributed between some combinations of such devices.

The interface bus is configured to communicate, transmit, and transfer data, controls, and commands between the various components of the electronic device. The system memory and the storage device comprise computer readable storage media, such as RAM, ROM, EEPROM, hard-drives, CD-ROMs, optical storage devices, magnetic storage devices, flash memory, and other tangible storage media. Any of such computer readable storage medium can be configured to store instructions or program codes embodying aspects of the disclosure. Additionally, the system memory comprises an operation system and applications. The processor is configured to execute the stored instructions and can comprise, for example, a logical processing unit, a microprocessor, a digital signal processor, and the like.

The system memory and the storage device may also comprise computer readable signal media. A computer readable signal medium may include a propagated data signal with computer readable program code embodied therein. Such a propagated signal may take any of variety of forms including, but not limited to, electro-magnetic, optical, or any combination thereof. A computer readable signal medium may be any computer readable medium that is not a computer readable storage medium and that can communicate, propagate, or transport a program for use in connection with the computing system.

Further, the input and output peripherals include user interfaces such as a keyboard, screen, microphone, speaker, other input/output devices, and computing components such as digital-to-analog and analog-to-digital converters, graphical processing units, serial ports, parallel ports, and universal serial bus. The input/output peripherals may also include a variety of sensors, such as light, proximity, GPS, magnetic field, altitude, and velocity/acceleration. RSSI, and distance sensors, as well as other types of sensors. The input/output peripherals may be connected to the processor through any of the ports coupled to the interface bus.

The user interfaces can be configured to allow a user of the computing system to interact with the computing system. For example, the computing system may include instructions that, when executed, cause the computing system to generate a user interface and carry out other methods and operations that the user can use to provide input to the computing system and to receive an output from the computing system.

This user interface may be in the form of a graphical user interface that is rendered at the screen and that is coupled with audio transmitted on the speaker and microphone and input received at the keyboard. In an embodiment, the user interface can be locally generated at the computing system. In another embodiment, the user interface may be hosted on a remote computing system and rendered at the computing system. For example, the server may generate the user interface and may transmit information related thereto to the computing device that, in turn, renders the user interface to the user. The computing device may, for example, execute a browser or an application that exposes an application program interface (API) at the server to access the user interface hosted on the server.

Finally, the communication peripherals of the computing system are configured to facilitate communication between the computing system and other computing systems (e.g., between the computing device and the server) over a communications network. The communication peripherals include, for example, a network interface controller, modem, various modulators/demodulators and encoders/decoders, wireless and wired interface cards, antenna, and the like.

The communication network includes a network of any type that is suitable for providing communications between the computing device and the server and may comprise a combination of discrete networks which may use different technologies. For example, the communications network includes a cellular network, a WiFi/broadband network, a local area network (LAN), a wide area network (WAN), a telephony network, a fiber-optic network, or combinations thereof. In an example embodiment, the communication network includes the Internet and any networks adapted to communicate with the Internet. The communications network may be also configured as a means for transmitting data between the computing device and the server.

The techniques described above may be embodied in, and fully or partially automated by, code modules executed by one or more computers or computer processors. The code modules may be stored on any type of non-transitory computer-readable medium or computer storage device, such as hard drives, solid state memory, optical disc, and/or the like. The processes and algorithms may be implemented partially or wholly in application-specific circuitry. The results of the disclosed processes and process steps may be stored, persistently or otherwise, in any type of non-transitory computer storage such as, e.g., volatile or non-volatile storage.

In an embodiment, a roulette mechanism for multi-ball roulette, comprising: a base; an annular stationary rim mounted on the base, the stationary rim having a central opening and an upwardly curved face around which one or more roulette balls travel; a rotating roulette wheel configured to spin in a first direction and positioned in the central opening of the stationary rim and supported by the base, the roulette wheel including a movable central cone and a number of pockets distributed around a perimeter of the movable central cone, the pockets configured to at least initially hold one or more roulette balls among the one or more roulette balls traveling from the curved face onto the roulette wheel and into one or more of the pockets, each of the pockets corresponding to unique identifiers on the roulette wheel, the movable central cone including an edge, a number of sub-pockets under at least a portion of the edge and a motor, the edge being configured to stop a roulette ball that has entered a pocket, the motor being configured to raise the edge so that the roulette ball moves from the pocket to the sub-pocket and to lower the edge once the roulette ball is in the sub-pocket; and a roulette ball launching system configured to launch the one or more roulette balls spinning around the stationary rim in one or more of the first direction and a second direction.

In the embodiment, wherein when the roulette ball is in the sub-pocket and a subsequent roulette ball enters the pocket, the edge will prevent the roulette ball and the subsequent roulette ball from touching.

In the embodiment, wherein the roulette ball in the sub-pocket is visible to players using the roulette mechanism.

In the embodiment, wherein the movable central cone is configured to raise and lower when the rotating wheel is spinning in the first direction.

In the embodiment, wherein the movable central cone is configured to raise and lower when the rotating wheel is stopped.

In the embodiment, wherein the roulette wheel further includes a turret having a plurality of openings embedded with translucent material through which one or more lights within the turret may be displayed.

In the embodiment, wherein the movable central cone includes a multiplier wheel having a plurality of multiplier values displayed thereon, each of the multiplier values corresponding to one or more of the pockets.

In the embodiment, wherein the movable central cone further includes lighting for highlighting each of the multiplier values.

In the embodiment, wherein the roulette wheel further includes lighting for highlighting each pocket and each of the unique identifiers.

In the embodiment, wherein the unique identifiers include 36 numbers and a plurality of symbols, and wherein the movable central cone includes a multiplier wheel having a plurality of multiplier values displayed thereon, each of the multiplier values corresponding to one of the unique identifiers.

In the embodiment, wherein the curved face of the stationary rim includes one or more paths around which at least a first roulette ball and one or more additional roulette balls among the one or more roulette balls travel, wherein the first roulette ball is launched by the roulette ball launching system onto one of the one or more paths to rotate around the stationary rim while moving down the curved face toward the roulette wheel as the first roulette ball loses momentum, and wherein the one or more additional roulette balls are launched by the roulette ball launching system onto the one or more paths without colliding with the first roulette ball or any additional roulette balls while travelling on the one or more paths.

In the embodiment, wherein the curved face includes an upper track and a lower track and a plurality of sections, wherein the upper track is formed between a first section and a second section and the lower track is formed between the second section and a third section.

In the embodiment, wherein the first section, the second section and the third section are substantially flat.

In the embodiment, wherein the first roulette ball moves to the lower track prior to the one or more additional roulette balls being launched onto the upper track, and wherein the first roulette ball moves out of the lower track prior to the one or more additional roulette balls moving to the lower track.

In the embodiment, wherein the curved face is smooth and continuously curves at sharper angles toward an outer edge of the stationary rim, and wherein the one or more roulette balls spiral down the curved face toward the roulette wheel.

In the embodiment, wherein the roulette ball launching system includes multiple launchers, and wherein the second direction is equal to the first direction, opposite of the first direction, or both.

In the embodiment, wherein the sub-pockets are each configured to store multiple roulette balls.

In the embodiment, further comprising a sensor to detect a presence of the roulette ball in the pocket and cause the motor to raise and lower the edge to deliver the roulette ball to the sub-pocket.

In the embodiment, wherein the sensor is positioned within at least one of the pocket, the edge, or the rim.

In the embodiment, wherein each sub-pocket includes a trap door configured to hold the roulette ball, and when opened, deliver the roulette ball to the roulette ball launchings system.

As previously noted, the various features and processes described above may be used independently of one another or may be combined in various ways. All possible combinations and sub-combinations are intended to fall within the scope of this disclosure. In addition, certain method or process blocks may be omitted in some implementations. The methods and processes described herein are also not limited to any particular sequence, and the blocks or states relating thereto can be performed in other sequences that are appropriate. For example, described blocks or states may be performed in an order other than that specifically disclosed, or multiple blocks or states may be combined in a single block or state. The example blocks or states may be performed in serial, in parallel, or in some other manner. Blocks or states may be added to or removed from the disclosed example embodiments. The example systems and components described herein may be configured differently than described. For example, elements may be added to, removed from, or rearranged compared to the disclosed example embodiments.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements, and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

The present disclosure describes particular embodiments and their detailed construction and operation. The embodiments described herein are set forth by way of illustration only and not limitation. Those skilled in the art will recognize, in light of the teachings herein, that there may be a range of equivalents to the exemplary embodiments described herein. Most notably, other embodiments are possible, variations can be made to the embodiments described herein, and there may be equivalents to the components, parts, or steps that make up the described embodiments. For the sake of clarity and conciseness, certain aspects of components or steps of certain embodiments are presented without undue detail where such detail would be apparent to those skilled in the art in light of the teachings herein and/or where such detail would obfuscate an understanding of more pertinent aspects of the embodiments.

The terms and descriptions used above are set forth by way of illustration only and are not meant as limitations. Those skilled in the art will recognize that those and many other variations, enhancements and modifications of the concepts described herein are possible without departing from the underlying principles of the invention. The scope of the invention should therefore be determined only by the following claims and their equivalents.

What is claimed:

1. A roulette mechanism for multi-ball roulette, comprising:

a base;

an annular stationary rim mounted on the base, the stationary rim having a central opening and an upwardly curved face around which one or more roulette balls travel;

a rotating roulette wheel configured to spin in a first direction and positioned in the central opening of the stationary rim and supported by the base, the roulette wheel including a movable central cone and a number of pockets distributed around a perimeter of the movable central cone, the pockets configured to at least initially hold one or more roulette balls among the one or more roulette balls traveling from the curved face onto the roulette wheel and into one or more of the pockets, each of the pockets corresponding to unique identifiers on the roulette wheel, the movable central cone including an edge, a number of sub-pockets under at least a portion of the edge and a motor, the edge being configured to stop a roulette ball that has entered a pocket, the motor being configured to raise the edge so that the roulette ball moves from the pocket to the sub-pocket and to lower the edge once the roulette ball is in the sub-pocket; and a roulette ball launching system configured to launch the one or more roulette balls spinning around the stationary rim in one or more of the first direction and a second direction.

2. The roulette mechanism of claim 1, wherein when the roulette ball is in the sub-pocket and a subsequent roulette ball enters the pocket, the edge will prevent the roulette ball and the subsequent roulette ball from touching.

3. The roulette mechanism of claim 1, wherein the roulette ball in the sub-pocket is visible to players using the roulette mechanism.

4. The roulette mechanism of claim 1, wherein the movable central cone is configured to raise and lower when the rotating wheel is spinning in the first direction.

5. The roulette mechanism of claim 1, wherein the movable central cone is configured to raise and lower when the rotating wheel is stopped.

6. The roulette mechanism of claim 1, wherein the roulette wheel further includes a turret having a plurality of openings embedded with translucent material through which one or more lights within the turret may be displayed.

7. The roulette mechanism of claim 1, wherein the movable central cone includes a multiplier wheel having a plurality of multiplier values displayed thereon, each of the multiplier values corresponding to one or more of the pockets.

8. The roulette mechanism of claim 7, wherein the movable central cone further includes lighting for highlighting each of the multiplier values.

9. The roulette mechanism of claim 1, wherein the roulette wheel further includes lighting for highlighting each pocket and each of the unique identifiers.

10. The roulette mechanism of claim 1, wherein the unique identifiers include 36 numbers and a plurality of symbols, and wherein the movable central cone includes a multiplier wheel having a plurality of multiplier values displayed thereon, each of the multiplier values corresponding to one of the unique identifiers.

11. The roulette mechanism of claim 1, wherein the curved face of the stationary rim includes one or more paths around which at least a first roulette ball and one or more additional roulette balls among the one or more roulette balls travel, wherein the first roulette ball is launched by the roulette ball launching system onto one of the one or more paths to rotate around the stationary rim while moving down the curved face toward the roulette wheel as the first roulette ball loses momentum, and wherein the one or more additional roulette balls are launched by the roulette ball launching system onto the one or more paths without colliding with the first roulette ball or any additional roulette balls while travelling on the one or more paths.

12. The roulette mechanism of claim 1, wherein the curved face includes an upper track and a lower track and a plurality of sections, wherein the upper track is formed between a first section and a second section and the lower track is formed between the second section and a third section.

13. The roulette mechanism of claim 12, wherein the first section, the second section and the third section are substantially flat.

14. The roulette mechanism of claim 12, wherein the first roulette ball moves to the lower track prior to the one or more additional roulette balls being launched onto the upper track, and wherein the first roulette ball moves out of the lower track prior to the one or more additional roulette balls moving to the lower track.

15. The roulette mechanism of claim 1, wherein the curved face is smooth and continuously curves at sharper angles toward an outer edge of the stationary rim, and wherein the one or more roulette balls spiral down the curved face toward the roulette wheel.

16. The roulette mechanism of claim 1, wherein the roulette ball launching system includes multiple launchers, and wherein the second direction is equal to the first direction or opposite of the first direction.

17. The roulette mechanism of claim 1, wherein the sub-pockets are each configured to store multiple roulette balls.

18. The roulette mechanism of claim 1, further comprising a sensor to detect a presence of the roulette ball in the pocket and cause the motor to raise and lower the edge to deliver the roulette ball to the sub-pocket.

19. The roulette mechanism of claim 18, wherein the sensor is positioned within at least one of the pocket, the edge, or the rim.

20. The roulette mechanism of claim 1, wherein each sub-pocket includes a trap door configured to hold the roulette ball, and when opened, deliver the roulette ball to the roulette ball launchings system.

* * * * *